US006044756A

United States Patent [19]

Chang

[11] Patent Number: 6,044,756

[45] Date of Patent: Apr. 4, 2000

[54] VACUUM POT CAPABLE OF SHOWING VACUUM STATUS

[76] Inventor: Kun Sheng Chang, 3F, No. 6, Alley 1, Lane 148, Min Tsu Road, Lu Chou, Taipei Hsien, Taiwan

[21] Appl. No.: 09/384,048

[22] Filed: Aug. 27, 1999

[51] Int. Cl.[7] ..... A47J 27/00; A47J 36/00; A45C 11/20

[52] U.S. Cl. ..... 99/472; 99/342; 99/493; 99/454; 220/212; 220/231; 220/214

[58] Field of Search ..... 99/342, 493, 343, 99/352–355, 454, 470, 472; 126/375, 369; 220/212, 231, 240, 592.27, 918, 271, 62.15, 319, 791, 260, 795, 270; 206/524.8, 550; 427/107, 234, 462; 141/65, 95, 192

[56] References Cited

U.S. PATENT DOCUMENTS

| | | | |
|---|---|---|---|
| 3,771,688 | 11/1973 | Frankenberg et al. | 220/271 |
| 4,111,330 | 9/1978 | Jordon | 220/319 |
| 4,498,378 | 2/1985 | Norrie et al. | 99/472 |
| 4,785,955 | 11/1988 | Sasaki | 220/62.15 |
| 5,398,811 | 3/1995 | Latella, Jr. | 99/472 X |
| 5,405,038 | 4/1995 | Chuang | 220/231 |
| 5,449,079 | 9/1995 | Yang | 141/65 |
| 5,535,900 | 7/1996 | Huang | 99/472 X |
| 5,558,243 | 9/1996 | Chu | 220/240 X |
| 5,611,376 | 3/1997 | Chuang | 220/231 |
| 5,651,470 | 7/1997 | Wu | 99/454 X |
| 5,806,575 | 9/1998 | Tsay | 99/472 X |
| 5,916,470 | 6/1999 | Besser et al. | 99/472 X |

*Primary Examiner*—Timothy Simone
*Attorney, Agent, or Firm*—Rosenberg, Klein & Lee

[57] ABSTRACT

A vacuum pot capable of showing the vacuum status comprises a container and a cover body. The cover body comprises a seat, a top lid, an air-pumping unit, and an indicating unit. The top lid connects with the seat. A groove is installed on the top edge of the top lid. The air-pumping unit is installed between the seat and the top lid to draw out the air inside the container unidirectionally by the pressing and releasing of an air-pumping button. The indicating unit has a retractable pump. One end of the retractable pump connects with the seat. The retractable pump connects with the inside of the container. The other end of the retractable pump connects with a rack. The rack is meshed with a gear. The gear is pivotably installed on the seat. The gear fixedly joins a pointer installed in the groove of the top lid. A scale is installed on the groove. Thereby articles can be superposed on the cover body, the vacuum degree of the vacuum pot can be known exactly, and the user can operate using only one hand.

7 Claims, 10 Drawing Sheets

VACUUM POT CAPABLE OF SHOWING VACUUM STATUS

FIELD OF THE INVENTION

The present invention relates to a vacuum pot capable of showing the vacuum status, especially to a vacuum pot capable of showing the vacuum status by a pointer to let the user know the vacuum degree exactly. There is no indicating unit protruding from the cover body. Articles can be superposed thereon.

BACKGROUND OF THE INVENTION

The conventional vacuum pot can be used to store food. Through the pumping out of the air in the vacuum pot, the spoiling of the food can be reduced, and the storage life of the food can be increased. As shown in FIG. 1, the conventional vacuum pot comprises a container 10*a* and a cover body 11*a*. The cover body 11*a* covers on the top opening of the container 10*a* to seal the container 10*a*. The top of the cover body 11*a* has an indicating button 12*a* and an admission button 13*a*. The sidewall of the cover body has an air-pumping handle 14*a*. Through the to-and-fro action of the air-pumping handle 14*a*, an internal piston (not shown in the figure) of the cover body 11*a* can be controlled to pump out the air in the container 10*a*. The inside of the container 10*a* will approach vacuum gradually. The vacuum degree of the container 10*a* can be judged by the height of the indicating button. When the cover body 11*a* is to be opened, the admission button 13*a* is pressed to let the inside of the container 10*a* be restored to regular pressure, facilitating the opening of the cover body 11*a*. A time table 15*a* can be installed on the top of the cover body 11*a* to show the placement date of the food.

The indicating button 12*a* of the conventional vacuum pot protrudes from the top of the cover body 11*a*. Therefore, no articles can be superposed on the cover body 11*a*. Also, the user must judge the vacuum degree by the height of the indicating button 12*a*. The error will be large, and the user can not know the vacuum degree of the vacuum pot exactly. Moreover, when the user uses the air-pumping handle 14*a* to pump out the air in the container 10*a*, he must use one hand to hold the container 10*a* or the cover body 11*a* and the other hand to hold the air-pumping handle 14*a* to draw to and fro. Single-handed operation is unworkable, resulting in inconvenient usage. Besides, because the time table 15*a* is situated on the top of the cover body 11*a*, if the vacuum pot is put at a high place, the time table 15*a* can not be seen. The user must get the vacuum pot from the high place to see the time table 15*a*, resulting in further inconvenient usage.

The primary object of the present invention is to provide a vacuum pot capable of showing the vacuum status by a pointer of the indicating unit. The pointer is installed in a groove of the top lid of the cover body and does not protrude from the top lid. Articles can thus be superposed on the cover body. Also, the user can know the vacuum degree from the pointed scale, and eye-measurement of the vacuum degree is not needed. The error is much reduced, and the vacuum degree of the vacuum pot can thus be known exactly.

Another object of the present invention is to provide a vacuum pot capable of showing the vacuum status, which characterizes in that when the air-pumping button of the air-pumping unit is pressed, it is not necessary to hold the container or the cover body. The user can operate it using only one hand, resulting in convenient usage.

Yet another object of the present invention is to provide a vacuum pot capable of showing the vacuum status, which characterizes in that the time table is installed on the sidewall of the cover body. Even if the vacuum pot is put at a high place, the time table can also be seen. It is not necessary to get it from the high place, resulting in further convenient usage.

The various objects and advantages of the present invention will be more readily understood from the following detailed description when read in conjunction with the appended drawing, in which:

DETAILED DESCRIPTION OF PREFERRED EMBODIMENT

Figure 1:
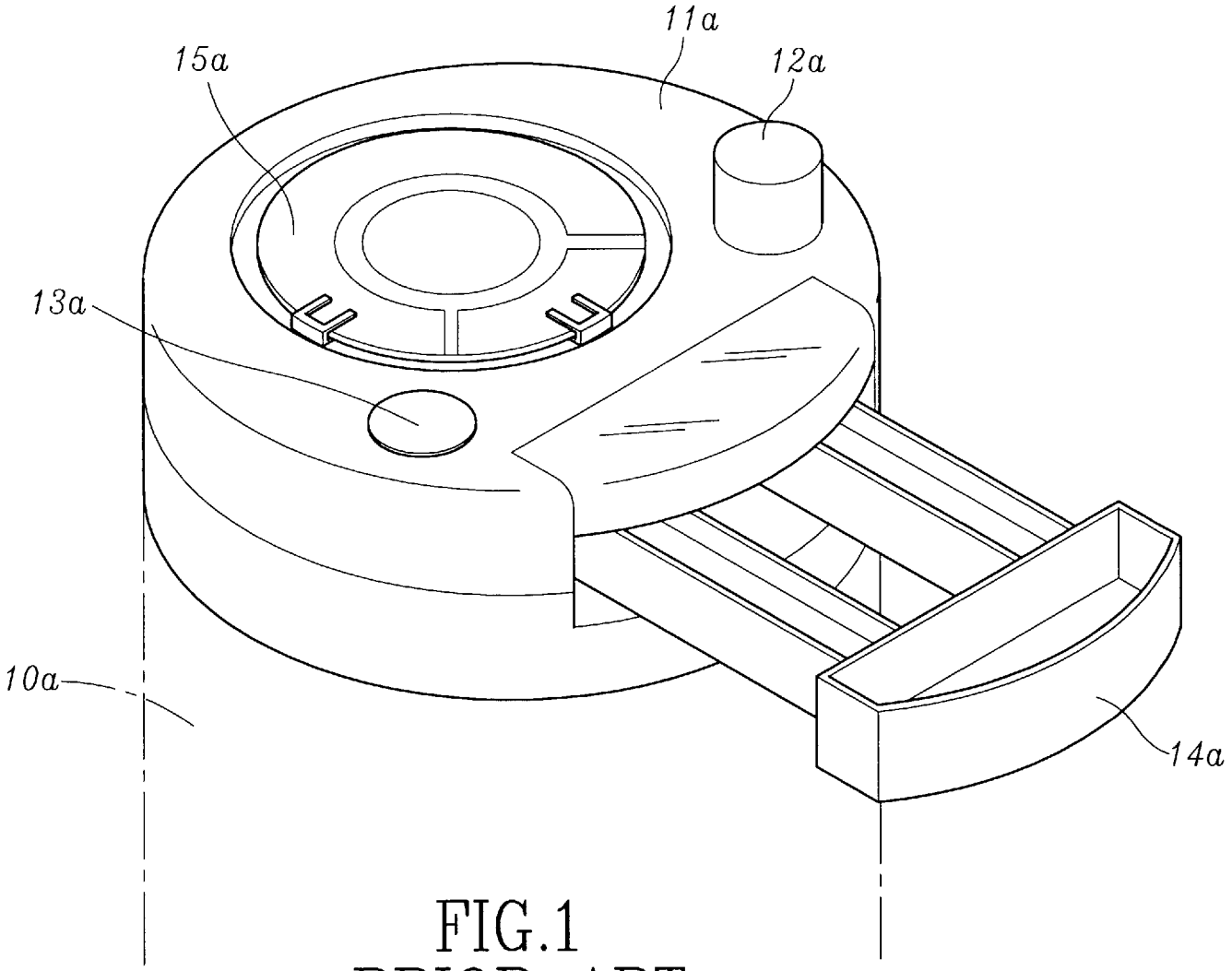
FIG.1 PRIOR ART
FIG. 1 is a perspective view of the conventional vacuum pot.
Figure 2:
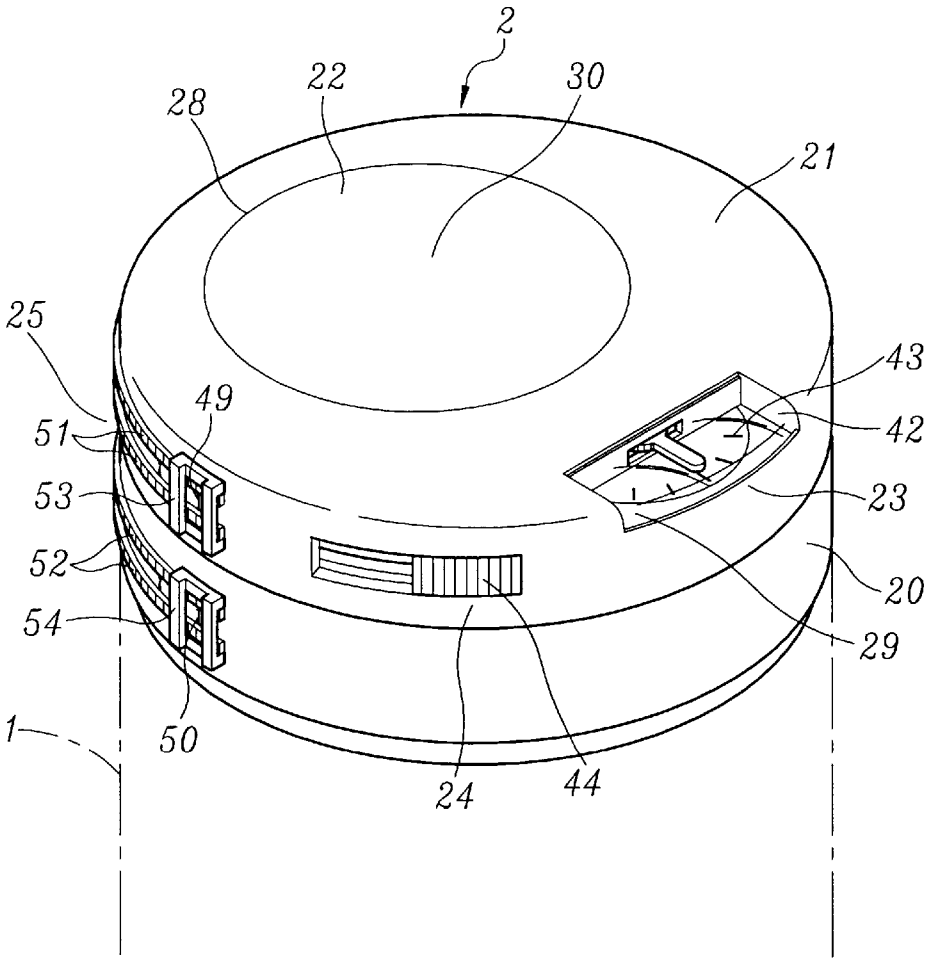
FIG. 2 is a perspective view of the vacuum pot capable of showing the vacuum status according to the present invention.
Figure 3:
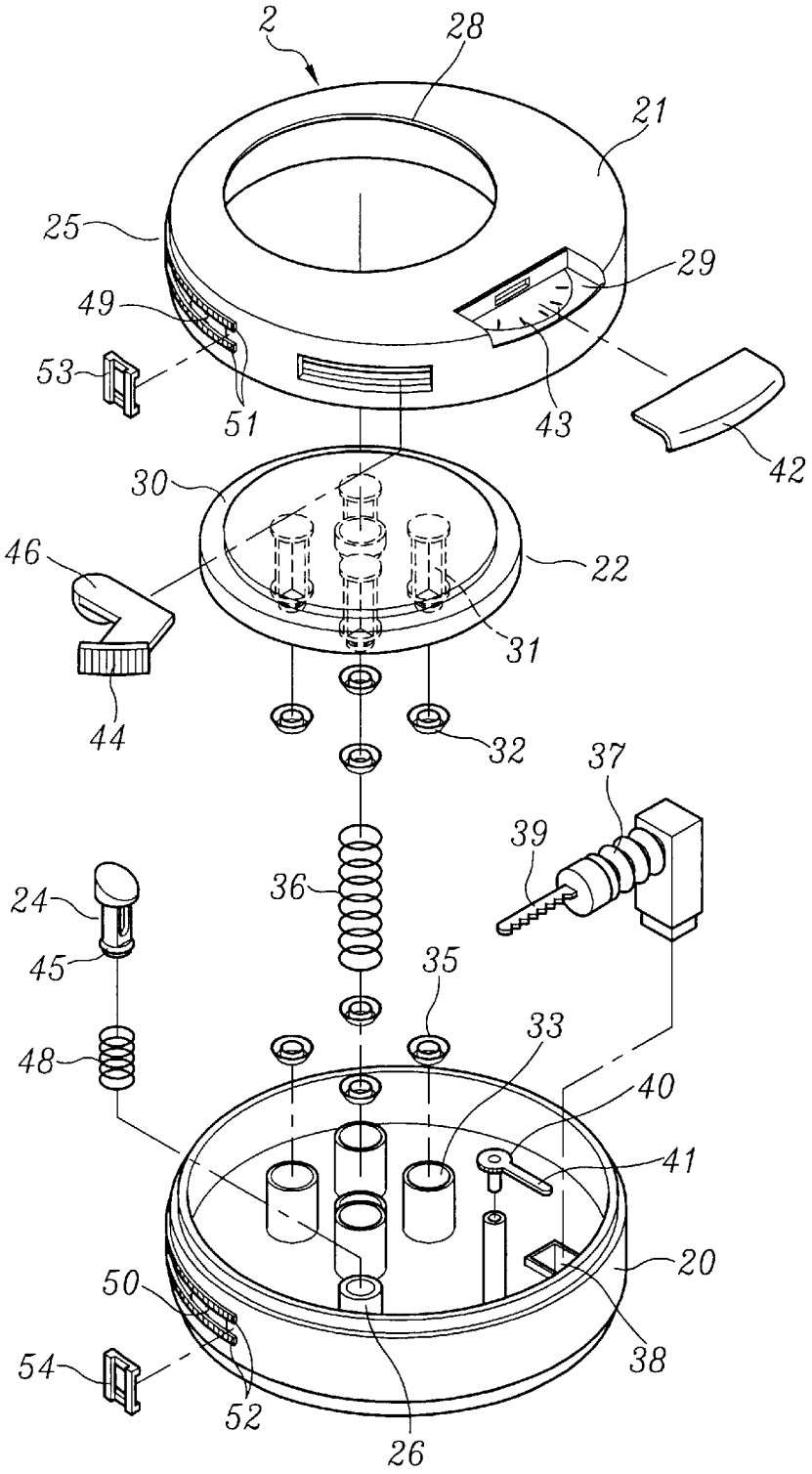
FIG. 3 is a perspective disassembly diagram of the vacuum pot capable of showing the vacuum status according to the present invention.
Figure 4:
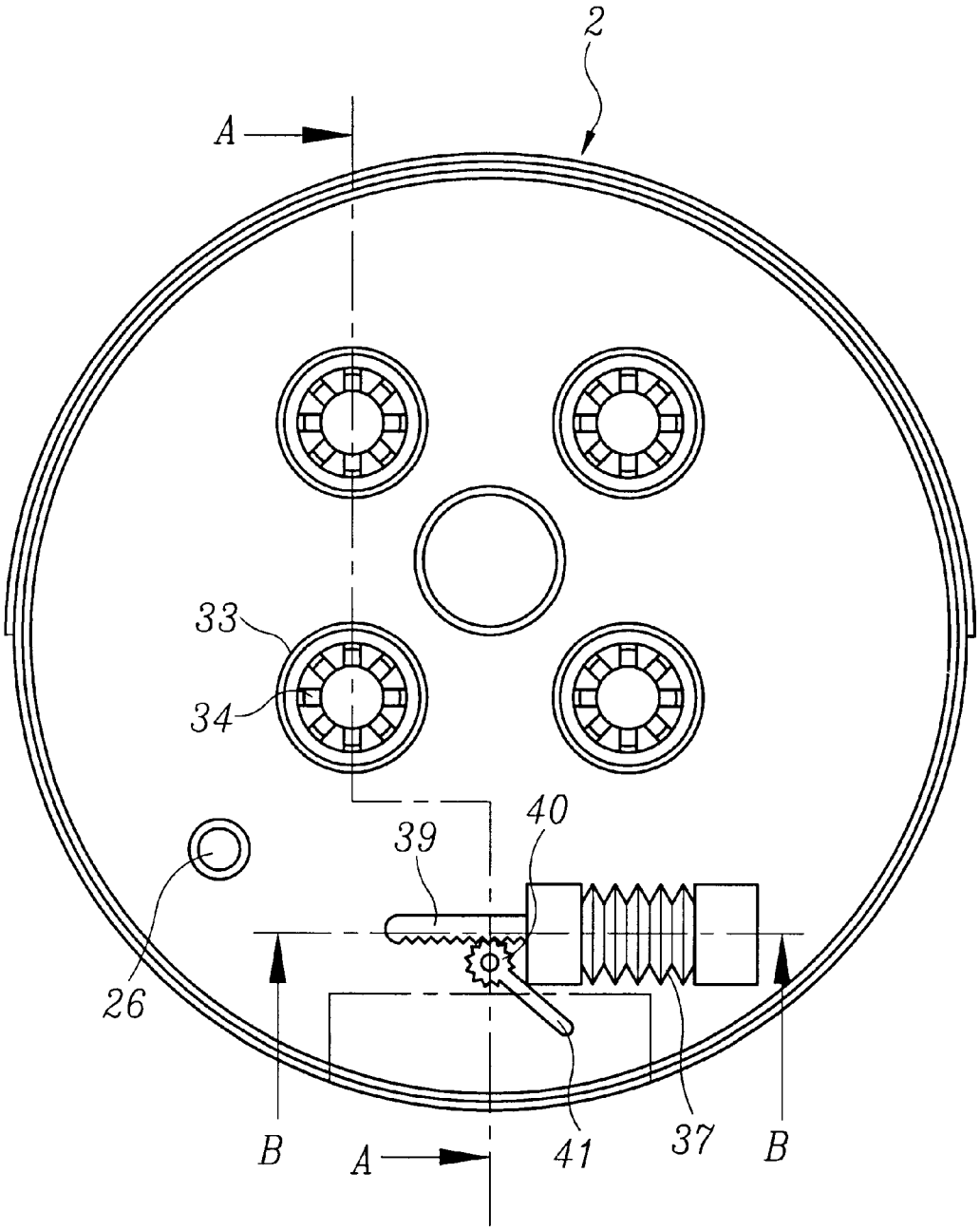
FIG. 4 is a top view showing the inside of the vacuum pot capable of showing the vacuum status according to the present invention.
Figure 5:
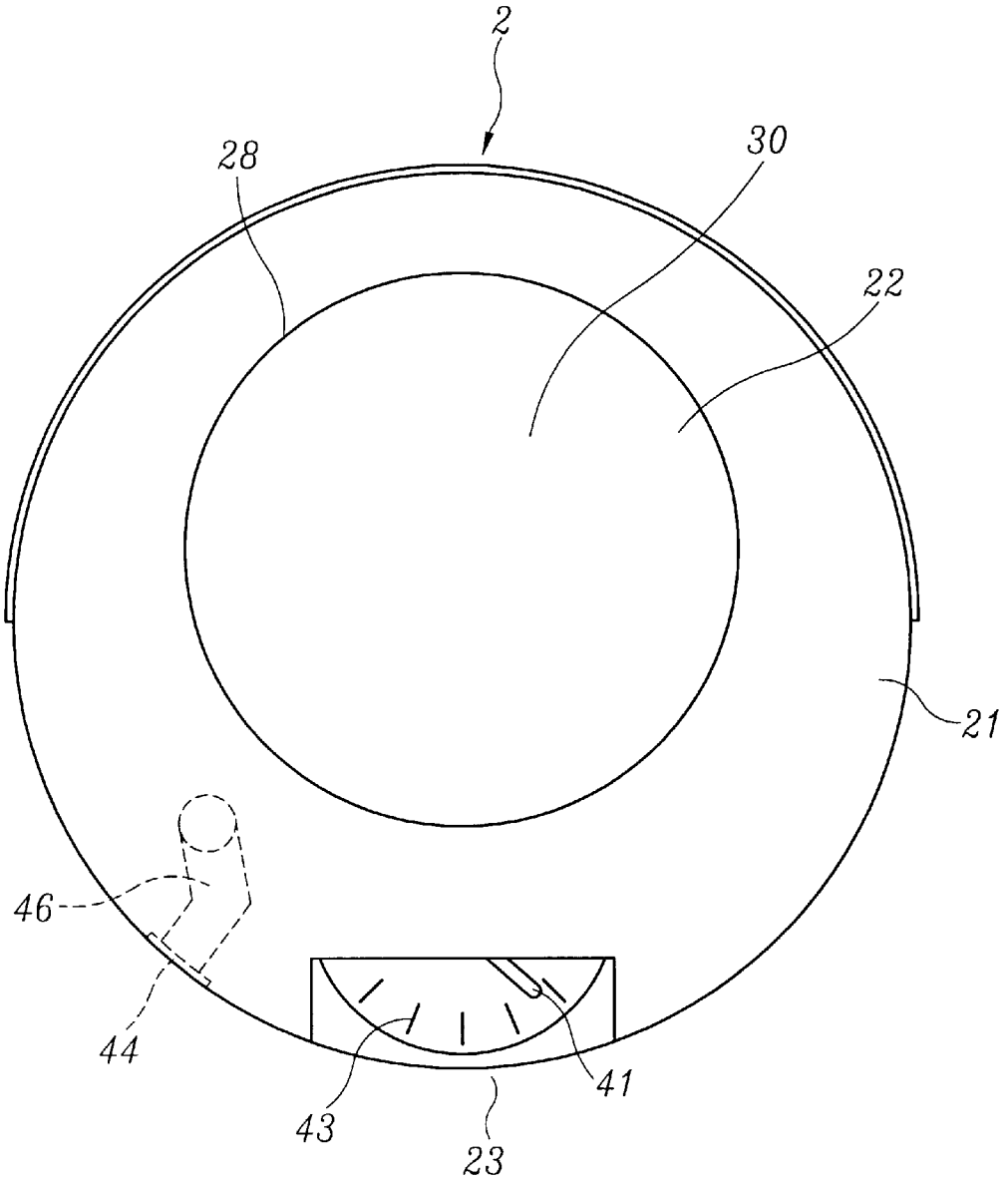
FIG. 5 is a top view of the vacuum pot capable of showing the vacuum status according to the present invention.
Figure 6:
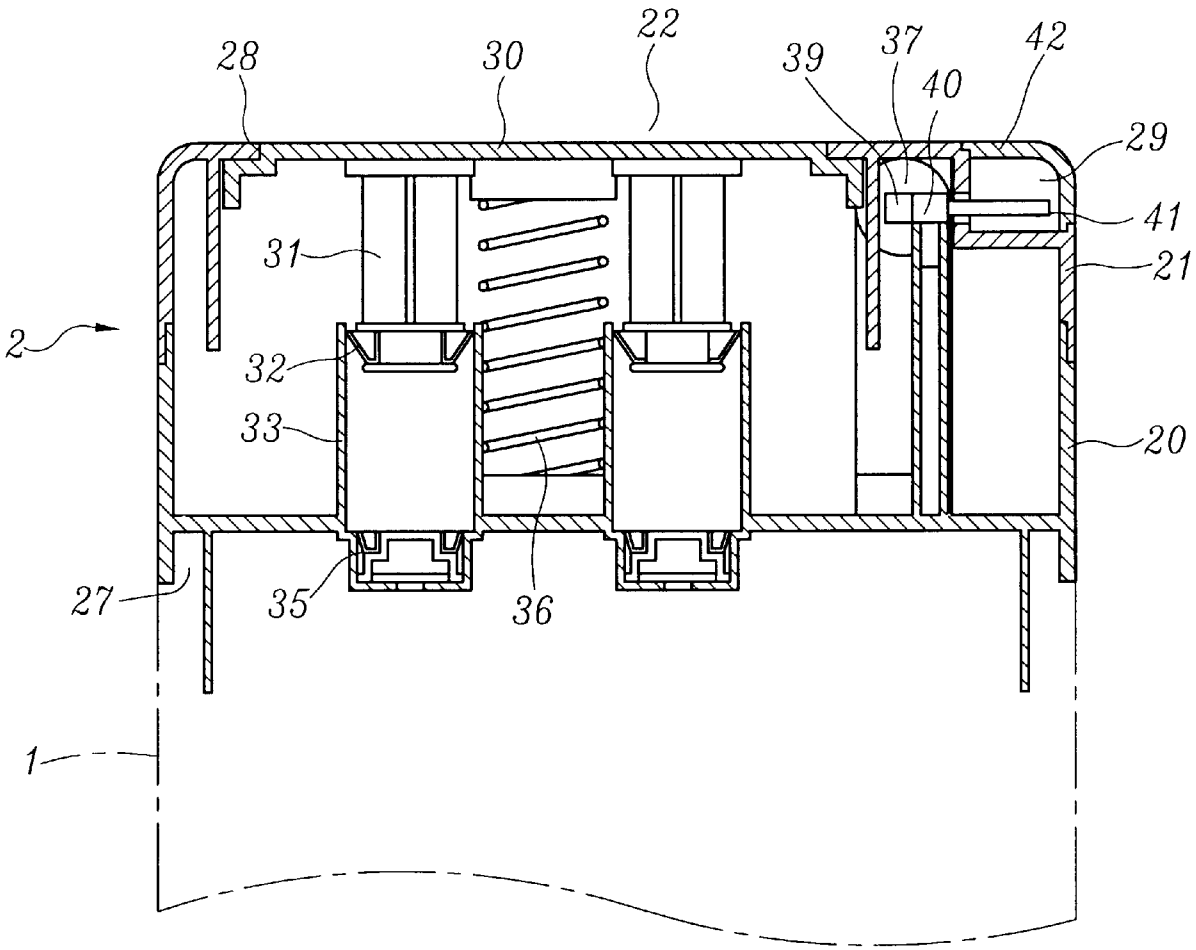
FIG. 6 is the cross section view A—A in FIG. 4.
Figure 7:
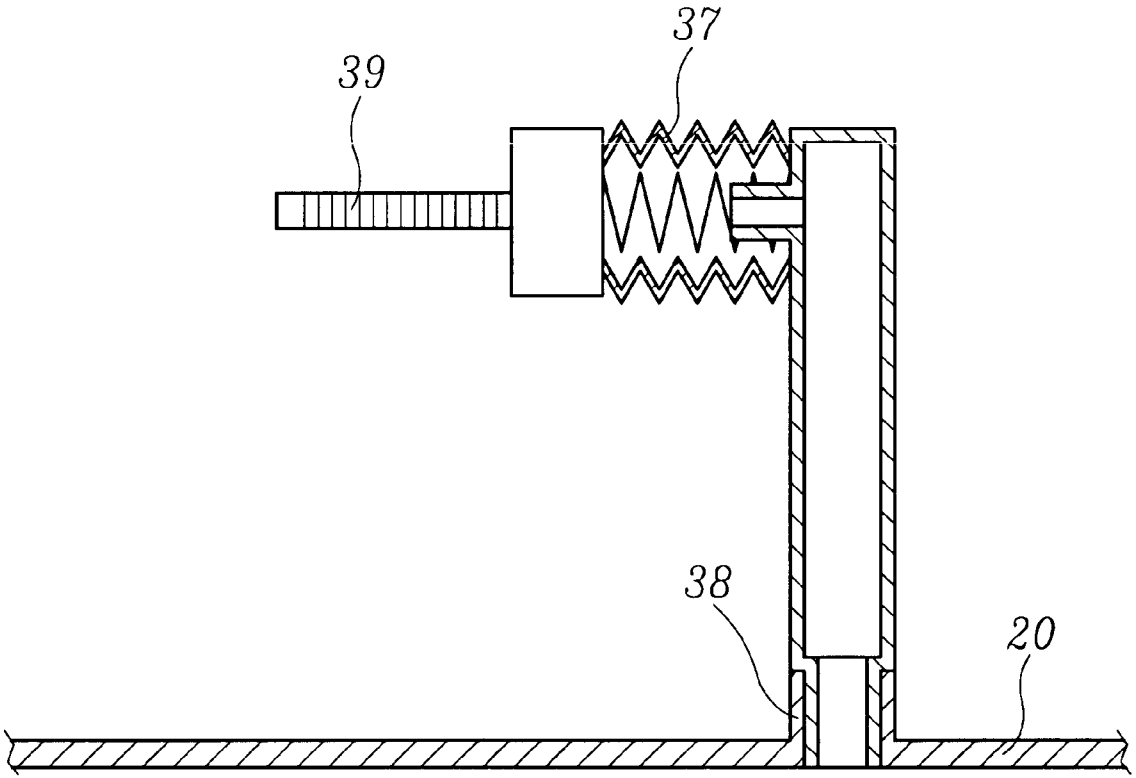
FIG. 7 is the cross section view B—B in FIG. 4.

As shown in FIGS. 2 to 7, the present invention provides a vacuum pot capable of showing the vacuum status, which comprises a container 1 and a cover body 2. The present invention focuses on the improvement of the cover body 2.

The cover body 2 comprises a seat 20, a top lid 21, an air-pumping unit 22, an indicating unit 23, an admission unit 24, and a time table 25. The seat is generally of circular shape. An annular locking part 27 is concavely installed on the bottom edge of the seat 20 to lock on the top of the container 1.

The top lid 21 is generally of circular shape. The bottom of the top lid 21 locks on the top of the seat 20. The top lid 21 and the seat 20 can be agglutinated properly to form a hollow shell body. The top lid 21 has a circular hole 28 on the top and a groove 29 on the top edge.

Figure 8:
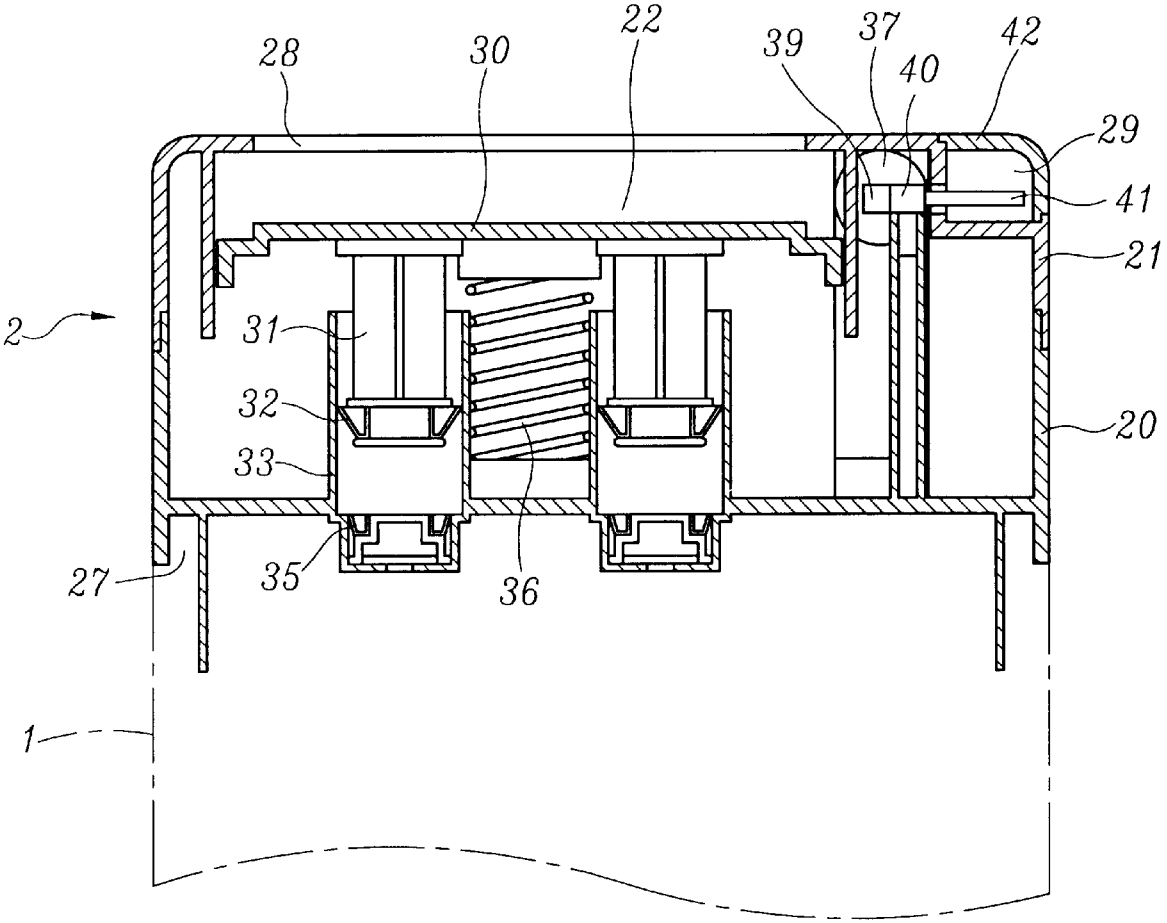
FIG. 8 is a diagram showing the operation of the air-pumping unit according to the present invention.

The air-pumping unit 22 is situated between the seat 20 and the top lid 21. The air-pumping unit 22 has an air-pumping button situated in the hole 28 on the top of the top lid 21. The bottom of the air-pumping button joins a plurality of piston bars 31. The bottom of each piston bar has a piston 32. A plurality of corresponding pumps 33 are mounted on the seat 20. The piston 32 is matched to the pump 33 individually. The bottom of the pump 33 has a predetermined number of vents 34. The pump 33 has a unidirectional valve 35 inside to let the air flow only in one direction. A predetermined number of resilient devices 36 are installed between the air-pumping button 30 and the seat 20 to restore the air-pumping button upwards. When the air-pumping button 30 is pressed (as shown in FIG. 8), the piston bars 31 and the pistons 32 are jointly moved downwards. The unidirectional valve 35 closes the vent 34 to let the air in the pump 33 flow out. When the air-pumping button is released, the resilient devices 36 will restore the air-pumping button 30 upwards. The air-pumping button 30 will move the piston bars 31 and pistons 32 upwards. The unidirectional valve 35 opens the vent 34 to let the air in the container be pumped into the pump 33. Through the pressing and releasing of the air-pumping button 30, the air in the container 1 can be drawn out unidirectionally to let the inside of the container approach vacuum.

Figure 9:
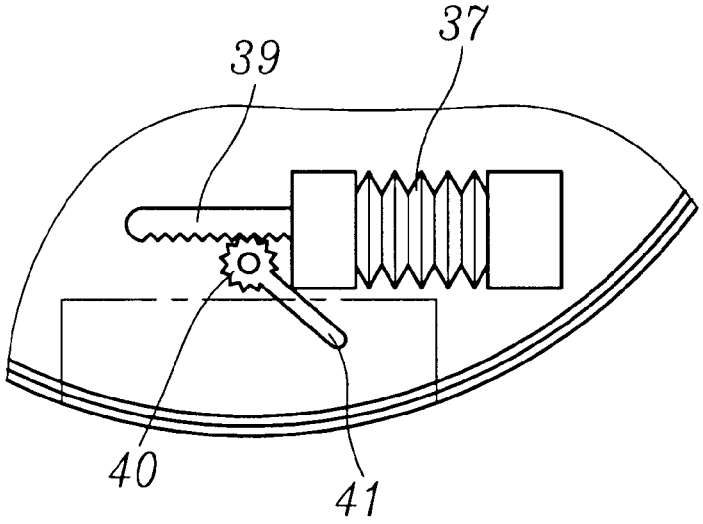
FIG. 9 is a diagram showing the operation of the indicating unit according to the present invention.
Figure 10:
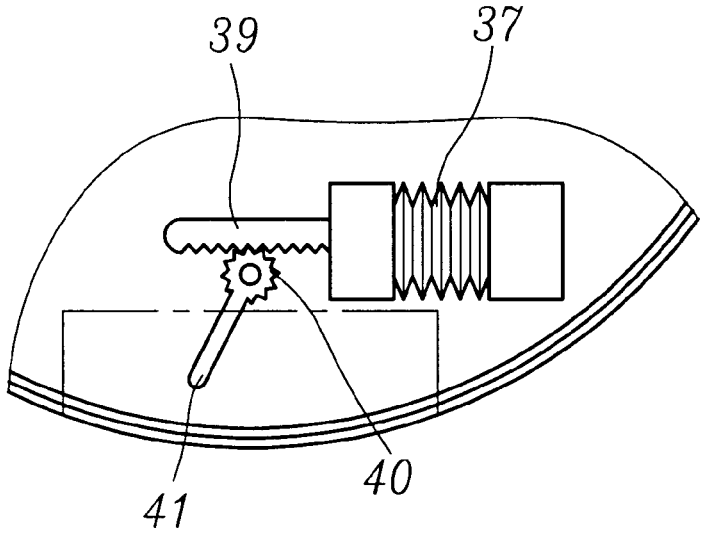
FIG. 10 is another diagram showing the operation of the air-pumping unit according to the present invention.

The indicating unit 23 has a retractable pump 37 (as shown in FIG. 9). One end of the retractable pump 37 connects with the seat 20 through a hole 38 on the seat. The retractable pump 37 can connects with the inside of the container 1 through the hole 38. The other end of the retractable pump 37 connects with a rack 39. The rack 39 is meshed with a gear 40 pivotably installed on the seat 20. The gear 40 fixedly joins a pointer 41 installed in the groove 29 of the top lid 21. A scale 43 is installed on the groove. A transparent lid 42 locks on the groove 29. When the air inside the container 1 is drawn out, a dragging force is generated to let the retractable pump 37 retract (as shown in FIG. 10). The rack 39 is thus jointly moved to turn the gear 40 and the pointer 41 connected with the gear 40. The pointed scale on the scale 43 can indicate the vacuum degree of the inside of the container 1.

Figure 11:
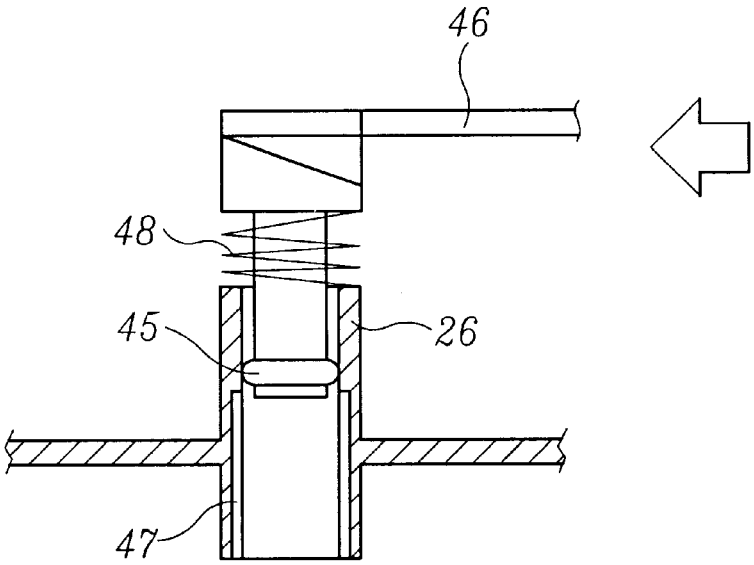
FIG. 11 is a diagram showing the operation of the admission unit according to the present invention.
Figure 12:
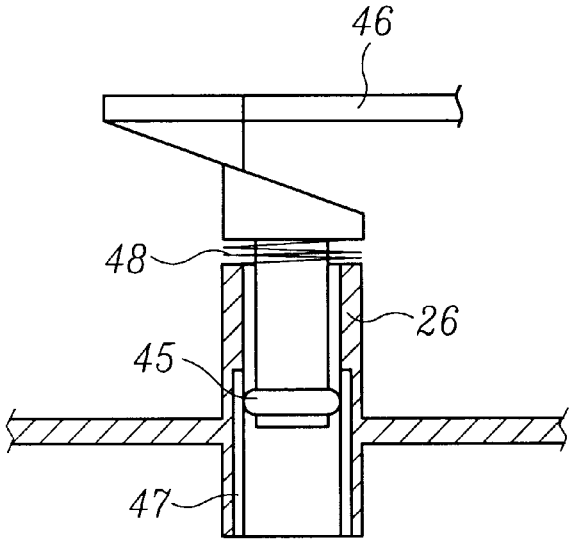
FIG. 12 is another diagram showing the operation of the admission unit according to the present invention.

The admission unit 24 is installed between the seat 20 and the top lid 21. The admission unit 24 has an admission button 44 and an admission valve 45. The admission button 44 is slidably matched on the sidewall of the top lid 21. The inside of the admission button 44 connects with a jointly-moving device 46. The admission valve 45 is matched in an admission chamber 26 mounted on the seat 20. The admission chamber 26 has an admission hole 47 (as shown in FIGS. 11 and 12) connected with the inside of the container 1. A resilient device 48 is installed between the admission chamber 26 and the jointly-moving device 46. The resilient device 48 can push the admission valve 45 to close the admission hole 47 (as shown in FIG. 11). When the admission button 44 is pressed, the jointly-moving device 46 is moved to push the admission valve 45. The admission valve 45 will then open the admission hole 47 (as shown in FIG. 12), and the inside of the container will be restored to regular pressure.

The time table 25 has the date numbers such as the month 49 and the day 50 installed on the sidewall of the seat 20 and the top lid 21, respectively. Slide grooves 51 and 52 are installed above and below the date numbers 49 and 50. The slide grooves 51 and 52 are slidably matched to two indicators 53 and 54. The two indicators 53 and 54 can slide freely on the slide grooves 51 and 52 to select certain date numbers 49 and 50 for representing the placement date of the food.

The indicating unit 23 uses the pointer 41 to point the scale 43 for indicating the vacuum degree of the inside of the container 1. The pointer 41 is installed in the groove 29 of the top lid 21 and does not protrude from the top lid 21. Articles can thus be superposed on the cover body. Also, the user can know the vacuum degree from the pointed scale 43, and eye-measurement of the vacuum degree is not needed. The error is much reduced, and the vacuum degree of the vacuum pot can thus be known exactly.

When the air-pumping button 30 of the air-pumping unit 22 is pressed to draw out the air inside the container, it is not necessary to hold the container 1 or the cover body 2. The user can operate using only one hand, resulting in convenient usage.

The time table 25 is installed on the sidewall of the cover body 2. Even if the vacuum pot is put at a high place, the time table 25 can also be seen. It is not necessary to get it from the high place, resulting in further convenient usage.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A vacuum pot capable of showing the vacuum status comprising a container and a cover body, said cover body covering on said container, said cover body comprising:

a seat;

a top lid connecting with said seat, the top edge of said top lid having a groove, an air-pumping unit installed between said seat and said top lid to draw out the air inside said container unidirectionally; and an indicating unit having a retractable pump, one end of said retractable pump connecting with said seat, said retractable pump connecting with the inside of said container, the other end of said retractable pump connecting with a rack, said rack meshed with a gear, said gear pivotably installed on said seat, said gear fixedly joining a pointer installed in said groove of said top lid, a scale installed on said groove.

2. The vacuum pot capable of showing the vacuum status as in claim 1, wherein said top lid has a hole on the top and said air-pumping unit has an air-pumping button, said air-pumping button installed in said hole on the top of said top lid, the bottom of said air-pumping button connecting with a plurality of piston bars, the bottom of each said piston bar having a piston, a plurality of corresponding pump mounted on said seat, said piston matched to said pump individually, the bottom of said pump having a predetermined number of vents, each said pump having an unidirectional valve inside to let the air only flow upwards, a predetermined number of resilient devices installed between said air-pumping button and said seat to restore said air-pumping button upwards.

3. The vacuum pot capable of showing the vacuum status as in claim 1, wherein an admission unit is installed between said seat and said top lid, said admission unit having an admission button and an admission valve, said admission button slidably matched to the sidewall of said top lid, the inside of said admission button connecting with a jointly-moving device, said admission valve matched in an admission chamber, said admission chamber mounted on said seat and having an admission hole, said admission hole connecting with the inside of said container, a resilient device installed between said admission chamber and said jointly-moving device to push said admission valve to close said admission hole, when said admission button pressed, said jointly-moving device moved to push said admission valve to open said admission hole, and the inside of said container thus restored to regular pressure.

4. The vacuum pot capable of showing the vacuum status as in claim 1, wherein a time table is installed on the sidewall of said seat and said top lid, said time table having date numbers, slide grooves installed above and below said date numbers, two indicators slidably matched to said slide grooves, said two indicators selecting a certain date.

5. The vacuum pot capable of showing the vacuum status as in claim 1, wherein the bottom edge of said seat having an annular locking part to lock on the top of the container.

6. The vacuum pot capable of showing the vacuum status as in claim 1, wherein said groove on the top of said top lid is installed on the top edge of the top lid.

7. The vacuum pot capable of showing the vacuum status as in claim 1, wherein said groove of said indicating unit has a transparent lid.

* * * * *